173-171

7/1/86 OR 4,597,453 SR

United States Patent [19]

Kilmer et al.

[11] Patent Number: 4,597,453

[45] Date of Patent: Jul. 1, 1986

[54] DRIVE UNIT WITH SELF-ALIGNING GEARING SYSTEM

[75] Inventors: Paul R. Kilmer, Leroy, Mich.; David S. Chapin, Raleigh, N.C.

[73] Assignee: Cooper Industries, Inc., Houston, Tex.

[21] Appl. No.: 699,931

[22] Filed: Feb. 8, 1985

[51] Int. Cl.[4] ..... B21F 15/04

[52] U.S. Cl. ..... 173/171; 408/126; 140/122; 140/124; 192/0.07; 74/801; 81/57.31

[58] Field of Search ..... 408/124, 126; 140/122, 140/124; 192/0.07; 74/801, 785; 173/12, 171; 81/57.11, 57.31

[56] References Cited

U.S. PATENT DOCUMENTS 3,998,565 12/1976 Tanaka ..... 408/124 X 4,284,109 8/1981 Kilmer et al. ..... 140/122

4,519,261 5/1985 Hamano ..... 74/801 X

*Primary Examiner*—James M. Meister

*Assistant Examiner*—John L. Knoble

*Attorney, Agent, or Firm*—Finnegan, Henderson, Farabow, Garrett & Dunner

[57] ABSTRACT

A drive unit for a power tool has a motor driven output gear rotatable about an output axis, a rotatable carrier plate, and a plurality of idler gears rotatably mounted on pins affixed to the carrier plate such that the gears engage the periphery of the output gear. The unit includes a drive shaft supported at one end by the carrier plate, and a non-rotatable ring gear floatingly mounted for engagement with the idler gears, whereby rotation of the output gear is coupled to the drive shaft, and hence to the tool bit, through the carrier plate and the carrier plate is urged toward rotational alignment with the axis of the output gear through the action of rotational forces.

11 Claims, 4 Drawing Figures

DRIVE UNIT WITH SELF-ALIGNING GEARING SYSTEM

FIELD OF THE INVENTION

This invention pertains to motor output drive units and, more particularly, to the type of drive unit adapted for use with relatively low cost, portable hand tools and the like.

BACKGROUND OF THE INVENTION

The present invention is an improvement on the portable terminal wrapping tool disclosed in U.S. Pat. No. 4,284,109 issued to P. R. Kilmer and R. M. Bula. The disclosure of this patent, incorporated by reference herein, describes one type of power tool system in which the improvements of the present invention may be employed. The terminal wrapping tool described in the Kilmer and Bula '109 patent is a light weight, convenient, reliable, and reasonably low cost unit. The improvements hereinafter disclosed further enhance the wear characteristics, associated with the gear reduction mechanism employed to couple drive torque from the electric drive motor to the rotatable tool bit. Drive train noise and vibration are reduced. Manufacturability of the drive mechanism is enhanced since the design permits relaxation of certain alignment tolerances without sacrificing performance. Convenience of use is increased by the provision of a readily adjustable index mechanism for controlling the starting angular position of the tool bit.

OBJECTS AND SUMMARY OF THE INVENTION

It is therefore an object of the present invention to provide an improved drive unit for a hand-held power tool.

A further object is to provide a planetary gear reduction system which can tolerate a degree of misalignment of the input and output shafts without producing excessive noise, vibration and wear.

Still a further object is to provide a high performance motor drive unit which can be mass produced inexpensively.

Yet another object is to provide a terminal wrapping tool which permits simple and quick adjustment of the angular starting point of a terminal wrap.

To achieve the foregoing objects, a drive unit for a power tool is provided including a motor driven output gear rotatable about an output axis, a rotatable carrier plate, and a plurality of idler gears rotatably mounted on pins affixed to the carrier plate such that the gears engage the periphery of the output gear. The unit includes a drive shaft supported at one end by the carrier plate, and a non-rotatable ring gear floatingly mounted for engagement with the idler gears, whereby rotation of the output gear is coupled to the drive shaft, and hence to a tool bit, through the carrier plate and the carrier plate is urged toward rotational alignment with the axis of the output gear through the action of rotational forces.

In accordance with another aspect of the invention, adjustability of the starting point of a terminal wrap is provided by a rotatable detent means which is secured to the tool case by a clamping nut. The detent means includes a stop member which cooperates with a stop panel affixed to a slidable clutch means positioned between the drive motor and the tool bit chuck. Movement of the clutch means toward the motor unlocks the drive shaft and applies drive torque to operate the tool bit. Movement of the clutch means toward the tool bit chuck removes the drive torque and engages the stop member and stop panel to arrest the tool bit in the desired angular position.

The accompanying drawings which are incorporated in and constitute a part of the specification, illustrate a preferred embodiment of the invention and together with the description, serve to explain the principles of the invention.

DETAILED DESCRIPTION OF THE EMBODIMENT

Figure 1:
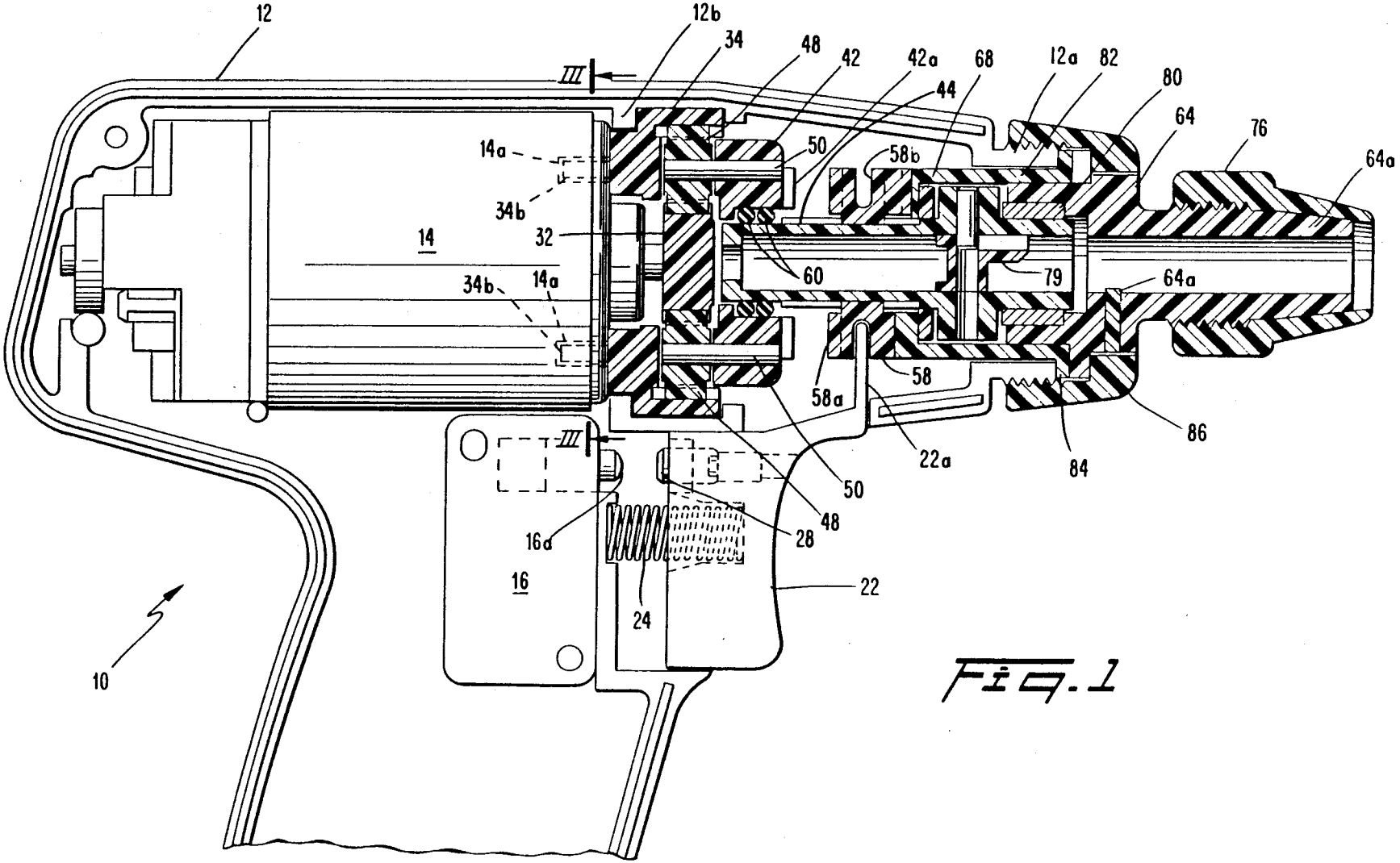
FIG. 1 is a cross-sectional view of a terminal wrapping tool employing the motor drive unit and gear reduction system of the present invention.
Figure 2:
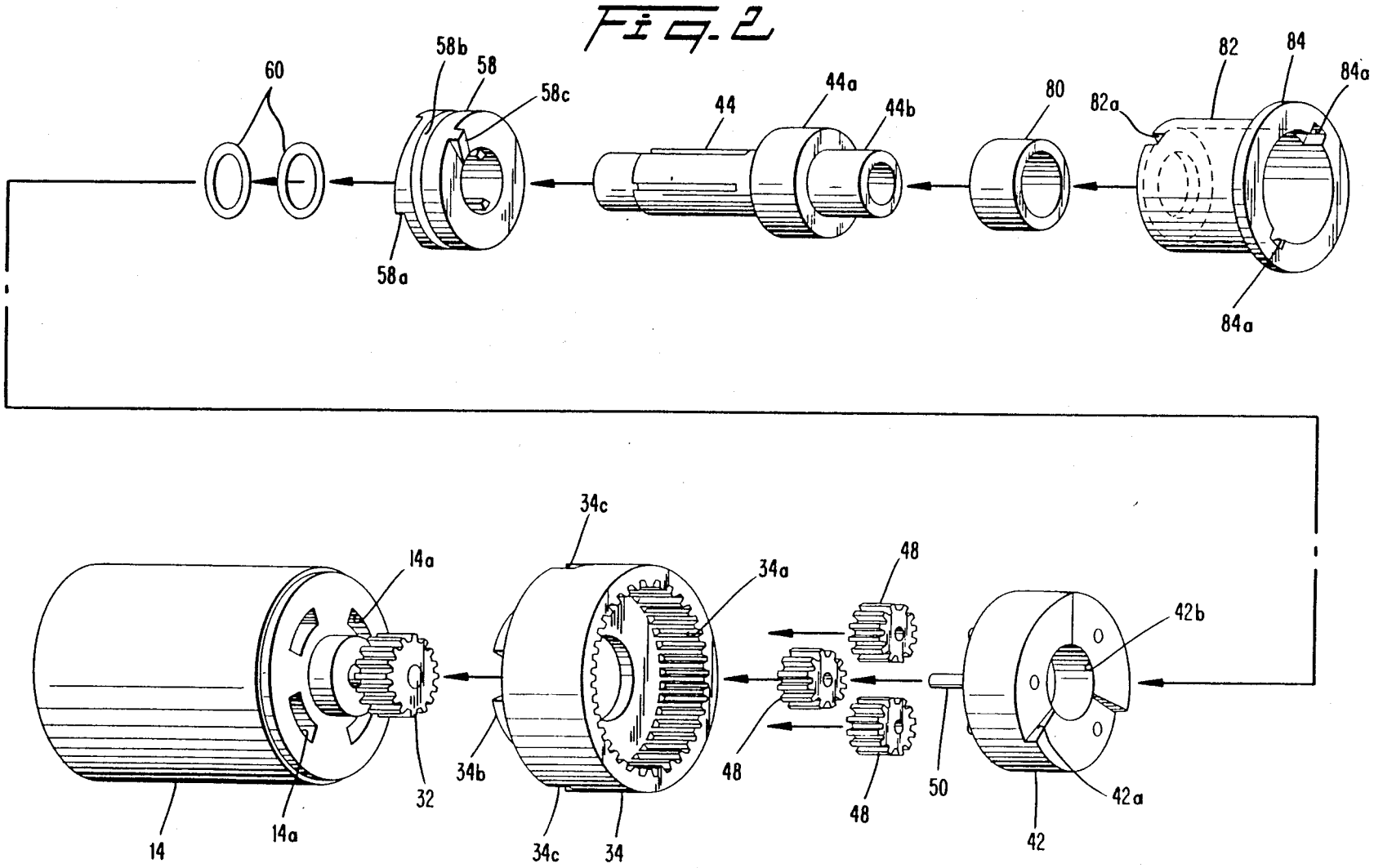
FIG. 2 is an exploded perspective view of the principal components of the motor drive unit shown in FIG. 1.

Referring to FIGS. 1 and 2, there is shown a hand-held terminal wrapping tool of the type used for making "solderless" connections in accordance with the general structure and operation of the tool described in the aforementioned Kilmer and Bula Pat. No. 4,284,109. The system includes a D.C. drive motor 14 seated within tool case 12. Motor 14 is operated by switch 16 which is opened and closed by a manually operable trigger 22 having a compression spring 24 which biases the trigger into the position shown in FIG. 1, whereby switch 16 is opened and motor 14 is inactive.

When the tool operator moves trigger 22 to the left against the bias of spring 24, a set-screw actuator 28 mounted in the upper portion of the trigger engages switch plunger **16*a* and turns motor 14 on. This causes the motor output pinion gear 32 to rotate, whereupon a planetary gear reduction system including carrier plate 42, idler gears 48, and ring gear 34 transmit the rotation of output gear 32 to a drive shaft 44**.

Carrier plate 42 supports three mounting pins 50 at equally spaced locations about a circle which is approximately concentric about the axis of output gear 32. Mounting pins 50 rotatably support the idler gears 48 such that the latter engage the teeth of output gear 32. Ring gear 34 is non-rotatable and engages the idler gears 48. As described hereinafter, the ring gear is floatingly mounted with respect to the axis of gear 32. Ring gear 34 is thus provided with a degree of radial play relative to the axis of rotation of output gear 32.

Carrier plate 42 is coupled to drive shaft 44 by a pair of O-rings 60 which encircle one end of the drive shaft and frictionally engage a cylindrical opening **42*b* (FIG. 2) provided in carrier plate 42. Drive shaft 44 is supported for rotation by a bearing sleeve 80 which is mounted in chuck member 64. Chuck 64 has a slotted nosepiece 64*a* into which a terminal wrapping bit (not shown) is inserted. A collet 76 permits the nosepiece 64*a* to be tightened down on the stationary outer sleeve of the wrapping tool to secure it in the chuck. Drive shaft 44 has an internal flat or tang 79 which engages a mating flat on the tool bit shank to couple the rotation of the drive shaft thereto. A lock pin 64a is provided in chuck 64** to engage a slot on the side of the tool bit sleeve, whereby the sleeve is positively secured against rotation.

The nose 12a of the tool case has a cylindrical opening in which a cup-shaped stop member 82 is rotatably seated. Stop member 82 has a lip 84 at its outer end which engages with the front edge of the tool case. Stop member 82 is keyed to chuck member 64 through a pair of slots 84a (FIG. 2) and mating lugs (not shown) provided on chuck member 64. The chuck member 64 and stop member 82 are clamped in a fixed position within the nose 12a of the tool case by a nose nut 86 which is threadably mounted on nosepiece 12a.

The inner end of stop member 82 is provided with a detent slot 82a which mates with a detent finger 58c extending from the end face of a slidable clutch block 58 (FIG. 2). As will be explained hereinafter, the detent finger 58c and mating slot 82a provide a manually adjustable indexing capability whereby the terminal wrapping bit is arrested in a selected angular position at the end of each wrapping cycle.

Clutch block 58 is spline-mounted on drive shaft 44 such that it is slidable axial of, but rotates with, the drive shaft. The clutch block has a peripheral groove 58b which engages an actuating arm 22a projecting from the top of the motor actuating trigger 22. When the operator releases trigger 22 at the end of a wrapping cycle, spring 24 biases the trigger to the right and continued inertial rotation of the output shaft of motor 14 and drive shaft 44 rotate the clutch block. This brings the detent finger 58c into alignment with detent slot 82a and the force of spring 24 causes the finger and slot to engage, arresting the drive shaft 44 and the wrapping bit at a position established by the location of slot 82a.

Drive shaft 44 is coupled to carrier plate 42 by a slip joint including a pair of O-rings which encircle a reduced diameter end portion of drive shaft 44. O-rings 60 frictionally engage the surface of cylindrical opening 42b provided in the carrier plate. Drive shaft 44 has an integral collar 44a which fits within stop member 82. A thrust bearing 68 is seated at the inner end of member 82 and is adjacent to collar 44a so that leftwardly directed axial forces exerted by the wrapping bit during the wrapping operation are absorbed by the thrust bearing.

Figure 3:
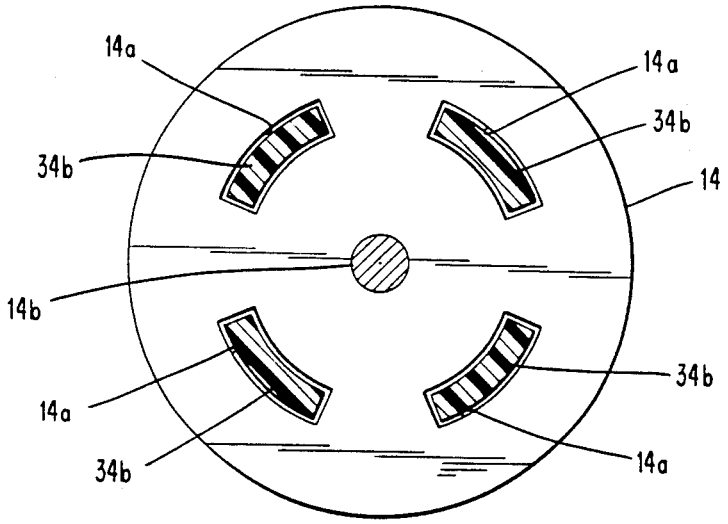
FIG. 3 is a cross-sectional view taken along the line III—III of FIG. 1.
Figure 4:
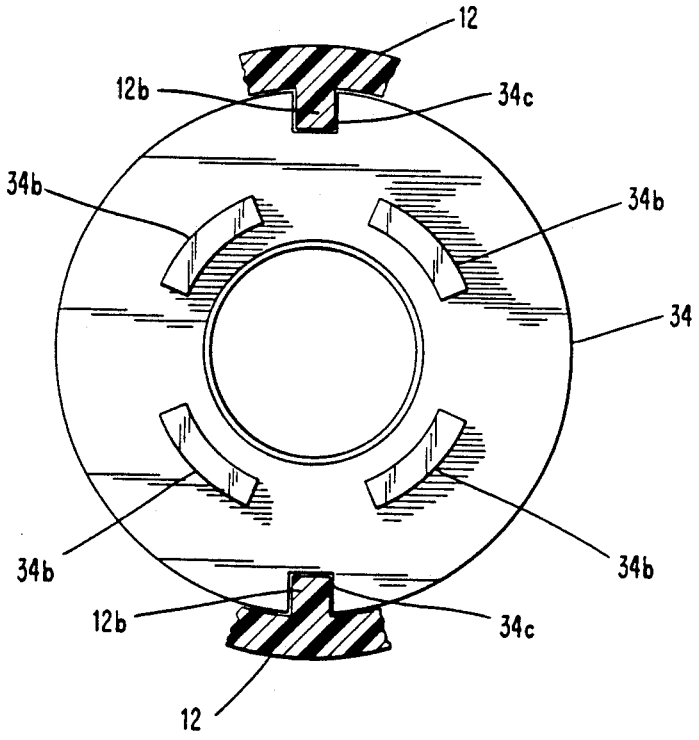
FIG. 4 is a rear view of the ring gear 34 showing the mechanism for mounting the ring gear in a radially floating position within the tool case.

A significant aspect of the present invention is in the structure of the ring gear 34 and its mounting on the face plate of motor 14. As shown in FIG. 4, the rear face of ring gear 34 has four arcuate lugs 34b projecting outwardly toward the motor 14. Lugs 34b mate with arcuate slots 14a provided in the face plate of the motor (FIG. 2). As indicated in FIGS. 1 and 3, lugs 34b fit loosely within the slots 14a such that a degree of radial play is provided such that ring gear 34 is floatingly mounted. In other words, ring gear 34 is permitted to shift its position in any radial direction about the axis of drive pinion 32. At the same time, however, the ring gear is prevented from rotating about the drive axis.

As shown in FIG. 4, rotation of ring gear 34 is blocked by a pair of tabs 12b projecting inwardly from tool case 12. Tabs 12b engage locking slots 34c provided in the periphery of ring gear 34. The amount of clearance between lugs 34b and slots 14a (FIG. 3) should be sufficient to permit the ring gear to shift about 0.040"-0.060" in any radial direction. Some clearance must be provided between tabs 12b and slots 34c (FIG. 4) so as not to impede this floating action. The use of four lugs 34b and mating slots 14a is exemplary only, it being understood that another number of lugs and slots, such as two or three, could be employed just as well.

OPERATION

In operation, the drive system is inactive in the position illustrated in FIG. 1 with trigger 22 biased into its rightmost position (FIG. 1). This locks drive shaft 44 through the locking engagement of detent finger 58c and its mating detent slot 82a. When trigger 22 is moved to the left through operator action, clutch block 58 slides to the left on the drive shaft 44 and the detent finger is withdrawn from the detent slot, freeing drive shaft 44 and the tool bit which is coupled thereto.

Further leftward travel of trigger 22 brings actuator 28 into contact with the switch plunger 16a and turns motor 14 on, whereupon drive pinion 32 starts to rotate. Rotation of the drive pinion rotates carrier plate 42 at a reduced angular velocity through the interaction of the drive pinion with idler gears 48, which in turn coact with the teeth of ring gear 34. The initial movement of carrier plate 42 is transmitted to drive shaft 44 through the frictional engagement of the O-ring slip coupling.

The final increment of leftward motion of trigger 22 brings the teeth 58a of the clutch block 58 into engagement with teeth 42a provided on the front face of the carrier plate 42. This positively couples the torque of the drive motor 14 to the drive shaft 44 and fully loads the motor. The axis of rotation of drive shaft 44 is established at the forward (right) end by the bearing sleeve 80. The axis of rotation of the rear (left) end of drive shaft 44, however, is not fixed since ring gear 34 floats in the manner previously described. Thus, the precise center of rotation of the left end of drive shaft 44 will be established by the position assumed by carrier plate 42 under the influence of the rotational forces generated by the rotating drive train. The planetary gear mechanism is thus self-aligning in that it seeks the center point which most evenly distributes the applied forces. Gearing noise and gear wear are accordingly reduced to a minimum.

When the terminal wrapping cycle is completed and the operator releases trigger 22, spring 24 urges the trigger back to its righthand limit position shown in FIG. 1 and the switch 16 is opened to remove power from motor 14. As the rotating components coast to a stop, spring 24 forces detent finger 58c into engagement with detent slot 82a (FIG. 2), arresting the rotation of drive shaft 44 and the tool bit coupled thereto at the angular position established by the location of detent slot 82a. The major impact forces of this sudden stop are isolated from the planetary gearing mechanism and the motor by the slipping action of the O-ring slip coupling 60.

When the operator desires to adjust the stopping location of the tool bit, it is necessary only to loosen nose nut 86 and to rotate the chuck member 64, which positions stop member 82 to the desired new location. After the nose nut 86 is retightened, the new position of detent slot 82a redefines the angular stopping point of drive shaft 44 and the tool bit.

The motor output drive unit of the present invention is simple in operation and inexpensive to manufacture. All of the principal component parts can be made of molded impact plastic. However, the mounting pins 50 and the tool bit coupling tang 79 and its locking pin are preferably metal parts. The bearing sleeve 80 and thrust bearing 68 may, for example, be constructed of a well known type of sintered bronze bearing material which is permanently impregnated with lubricant.

A principal advantage of the arrangement lies in the ability of the drive shaft 44 to be self-aligning with the output axis of the motor 14. That is, the unique floating suspension of ring gear 34, coupled with the absence of any fixed bearing at the motor end of drive shaft 44, allows the planetary carrier plate 42 and the left end of the drive shaft to rotate about the axis of output gear 32. This is true even though drive shaft 44 is not exactly coaxial with the motor drive shaft. Thus, the location of the center axis of bearing 80 with respect to the axis of motor 14 is not as critical a factor in achieving smooth operation of the drive train. Manufacturing tolerances can therefore be relaxed, and cost reduced, while still obtaining superior performance characteristics.

Additionally, the angular stopping position of the drive shaft 44 and the tool bit is conveniently adjustable through the operation of nose nut 86 and the rotatable stop member 82. This permits an operator, using finger pressure only, to reset the angular starting position of a terminal wrap simply and quickly without interrupting wrapping operations an undue amount. This results in less frequent shifts in the operator's wrist and hand positions and reduces operator fatique so that fewer defective wraps are experienced.

In summary, it is seen that in accordance with one aspect of the invention, a drive unit for a power tool is provided including a motor driven output gear rotatable about an output axis. As illustrated in the above-described exemplary embodiment, the motor driven output gear may be represented by the gear 32. The arrangement also includes a rotatable carrier plate which, in the example described above, may be the carrier plate 42 which includes a plurality of idler gears, such as the gears 48, rotatably mounted on pins which are affixed to the carrier plate and positioned to engage the periphery of the output gear.

The arrangement also includes a drive shaft supported at one end by the carrier plate, the drive plate being represented in the above-described exemplary embodiment by the shaft 44. There is also provided a non-rotatable ring gear floatingly mounted for engagement with the idler gears in a position approximately concentric with the output axis, whereby rotation of the output gear is coupled to the drive shaft through the carrier plate and the carrier plate is urged by rotational forces into substantial alignment with the axis of the output gear. As illustrated by the example hereinabove described, the non-rotatable ring gear is represented by the ring gear 34 which is floatingly mounted by virtue of the clearance which is provided between the mounting lugs **34*b* and the mating slots 14*a*** provided in the face of the motor.

In accordance with another aspect of the invention, there are provided drive shaft detent means for locking rotation of the drive shaft at a predetermined angular position when power is removed from the drive motor. The drive shaft detent means includes stop means, including a stop member, adjustably mounted on the tool case. As illustrated in the above-described exemplary embodiment, the stop means is represented by the member 82 having a stop member in the form of detent slot **82*a*. The arrangement further includes clutch block means slidably affixed via a splined coupling to the drive shaft, the clutch block means having a detent member adapted to positively engage the stop member to lock the drive shaft against rotation. As exemplified in the above embodiment, the clutch block means may be represented by clutch block 58 having a detent member in the form of detent finger 58*c***.

Finally, there is provided a clamping nut for affixing the stop means to the power tool case such that the angular position of the stop member can be changed by loosening the clamping nut and rotating the stop means. As exemplified in the embodiment hereinabove described, the clamping nut may be represented by nose nut 86 which permits the member 82 to be rotated upon loosening of the clamping nut so that the angular position of the detent slot **82*a*** can be adjusted.

It will be apparent to those skilled in the art that various modifications and variations can be made to the embodiment of the invention as hereinabove described without departing from the spirit and scope of the invention.

What is claimed is:

1. A motor output drive for a power tool comprising, in combination:

a motor driven output gear rotatable about an output axis;

a drive shaft rotatably supported at a first end in a bearing establishing an axis of rotation which is fixed with respect to the case of said power tool;

idler gear means coupled to said drive shaft at an end opposite said first end, said idler gear means including a carrier plate and a plurality of idler gears which engage said output gear and which are rotatably mounted on pins fixed to said carrier plate at locations on a circle concentric with said output axis;

non-rotatable ring gear means having teeth positioned on a ring concentric with said output axis and engaging the teeth of said idler gears, whereby said idler gears rotate about their mounting pins in response to rotation of said output gear causing the rotation of said output gear to be transmitted to said drive shaft at a reduced angular velocity; and suspension means supporting said ring gear means in a radially floating position such that said idler gear means acts in response to centrifugal force to seek a center of rotation aligned with said output axis.

2. The motor output drive of claim 1 wherein said drive shaft is supported for rotation only by said bearing at said first end and by said idler gear means.

3. The motor output drive of claim 1 wherein said suspension means comprises:

a motor face plate adjacent to said output gear;

a plurality of arcuate slots provided in said motor face plate; and arcuate lug means affixed to said ring gear means and arranged to fit loosely within said arcuate slots whereby said ring gear has freedom to move a limited amount radially with respect to said output axis but is locked against rotation about said axis.

4. The motor output drive of claim 1 having three idler gears supported on mounting pins which are spaced at 120° intervals about said concentric circle.

5. The motor output drive of claim 1 further including resilient coupling means interconnecting said idler gear means and said drive shaft in a manner allowing the latter to rotate about an axis which is skewed with respect to said output axis.

6. The output drive of claim 5 wherein said resilient coupling means comprises O-ring means encircling said drive shaft near said opposite end, said O-ring means frictionally engaging a cylindrical opening provided in said carrier plate of said idler gear means.

7. The motor output drive of claim 6 further comprising:

an electric motor for driving said output gear;

manually operable switch means for supplying power to said motor; and drive shaft detent means for locking the rotation of said drive shaft at a predetermined angular position after said switch means has been released to remove power from said motor.

8. The motor output drive of claim 7 wherein said drive shaft detent means comprises:

stop means adjustably mounted on the case of said power tool and including a stop member;

clutch block means slidably affixed via a splined coupling to said drive shaft, said clutch block means having a detent member adapted to positively engage said stop member to lock said drive shaft against rotation; and spring means for biasing said clutch means into engagement with said stop means when said switch means is released to remove power from said motor, whereby on release of said switch means said drive shaft is locked against rotation and said O-ring means slips in said cylindrical opening to isolate said motor and motor output drive from the impact of said locking action.

9. The motor output drive of claim 8 further including a clamping nut for affixing said stop means to said power tool case such that the angular position of said stop member can be changed by loosening said clamping nut and rotating said stop means.

10. A drive unit for a power tool comprising in combination:

a motor driven output gear rotatable about an output axis;

a rotatable carrier plate;

a plurality of idler gears rotatably mounted on pins affixed to said carrier plate and positioned to engage the periphery of said output gear;

a drive shaft supported at one end by said carrier plate; and a non-rotatable ring gear floatingly mounted for engagement with said idler gears in a position approximately concentric with said output axis, whereby rotation of said output gear is coupled to said drive shaft through said carrier plate and said carrier plate is urged by rotational forces into substantial alignment with said output axis.

11. A drive unit for a power tool comprising in combination:

a drive motor having an output member supplying drive torque;

a drive shaft for driving a tool bit;

clutch means slidably mounted on said drive shaft;

trigger means operable to move said clutch means away from said tool bit into engagement with said output member to couple drive torque to said drive shaft;

detent means adjustably mounted on the case of said power tool and including a stop member;

a stop pawl affixed to said clutch means and engagable with said detent means when said clutch means is moved toward said tool bit;

means for moving said clutch means toward said tool bit when said trigger is released to remove said drive torque, said movement engaging said stop member and stop pawl to arrest rotation of said drive shaft and tool bit in a predetermined angular position; and clamping means for releasably clamping said detent means, whereby the position of said detent means can be adjusted to change the stopping point of said drive shaft and tool bit.

* * * * *